US006733082B1

(12) United States Patent
Treon

(10) Patent No.: US 6,733,082 B1
(45) Date of Patent: May 11, 2004

(54) INTERLOCKING STADIUM SEATING SYSTEM

(75) Inventor: Steven R. Treon, Bath, PA (US)

(73) Assignee: Dant Clayton Corporation, Louisville, KY (US)

( * ) Notice: Subject to any disclaimer, the term of this patent is extended or adjusted under 35 U.S.C. 154(b) by 0 days.

(21) Appl. No.: 09/668,513

(22) Filed: Sep. 22, 2000

Related U.S. Application Data

(60) Provisional application No. 60/156,298, filed on Sep. 24, 1999.

(51) Int. Cl.[7] ..... A47C 7/00
(52) U.S. Cl. ..... 297/440.22; 297/248
(58) Field of Search ..... 297/440.22, 440.1, 297/248, 232; 40/320

(56) References Cited

U.S. PATENT DOCUMENTS 3,116,090 A * 12/1963 Kornbluth
3,466,087 A 9/1969 Motter, III ..... 297/232
3,482,874 A * 12/1969 Henebry et al.
3,531,157 A * 9/1970 Duckett et al.
3,702,204 A * 11/1972 Tipton et al.
3,989,299 A 11/1976 De Long ..... 297/411
4,126,354 A 11/1978 DeLong et al. ..... 297/248
4,244,621 A 1/1981 Lazaroff et al. ..... 297/218
4,307,914 A 12/1981 Grandclement ..... 297/458
4,438,603 A 3/1984 Durkan, Jr. ..... 52/8
4,490,949 A 1/1985 Sutter et al. ..... 52/9
4,518,199 A 5/1985 Lewis ..... 297/248
4,790,594 A 12/1988 Temos ..... 297/248
5,857,742 A * 1/1999 Karl et al.

* cited by examiner

*Primary Examiner*—Milton Nelson, Jr.
(74) *Attorney, Agent, or Firm*—Woodard, Emhardt, Moriarty, McNett & Henry LLP

(57) ABSTRACT

An interlocking stadium seating system comprising one-piece molded plastic seating modules having tab and blind rabbets for interlocking adjacent modules when placed in a side-by-side relationship in rows. The seat modules are secured to the common supporting structure by fasteners passing through openings that are disposed through the tabs and blind rabbets. This mean of attachment allows the entire surface of the seat module be used for sitting purpose. Additionally, the openings include sufficient play to allow rotational and translational movement between adjacent interlocked modules thereby enabling the seat modules to be placed in a straight line or at slight angle for adaptation to the existing architecture of the stadium.

19 Claims, 18 Drawing Sheets

INTERLOCKING STADIUM SEATING SYSTEM

CROSS-REFERENCE TO RELATED APPLICATION

The present application claims the benefit of U.S. Provisional Application Serial No. 60/1156298, entitled INTERLOCKING CONTOURED STADIUM SEATING SYSTEM, filed on Sept. 24, 1999. The referenced application is incorporated herein by reference in its entirety.

FIELD OF THE INVENTION

This invention relates generally to stadium seating, and in particular to individual seat modules that are combined into an interlocking stadium seating system which is applicable for retrofitting an existing stadium or for installation in new construction.

BACKGROUND OF THE INVENTION

In the past, primarily because of their lesser cost, many stadiums were fitted with bleacher type seating. Such seating in general does not provide clear demarcation of individual seating spaces. In addition, bleachers are notoriously uncomfortable to sit on for the entire length of an event. As the demand for reserved seating sections rises, facility managers often desire to replace the bleacher seating sections with a more comfortable and individualized seating arrangement which is also adaptive to the existing geometry of the stadium. To that end, many stadiums have installed chair style seating. However, refitting existing bleachers with a lift up or one piece molded chair is not an option for many stadiums because the tread depth of the stepping tier (the tier step on which the seat occupants would normally stand or walk to and from seats within a seating row) would not meet current codes. Also, the cost of individual chair type seating can be prohibitive. Various suggestions to resolve these issues have been offered and have met with varying degrees of success.

U.S. Pat. No. 4,244,621 issued to Lazaroff et al. discloses a seating arrangement comprising a continuous series of overlapping molded plastic, hollow seat modules. Each module includes two opposing sides with a fastening strip extended out from one side and a recess disposed at the bottom surface of the opposing side. A seating row is built by overlapping the recess of one module over the fastening strip of the adjacent module. The adjacent seat modules are interconnected with fasteners in a straight line arrangement. This seating arrangement made no provision for installation in a curved stadium.

U.S. Pat. No. 4,307,914 issued to Grandclement discloses a stadium seat for stadium terraces comprising a shell made of plastic material adapted to be affixed to terraces made of masonry. The seat has a downwardly directed front edge, of which the rear face is directed to follow the curvature of the corresponding surfaces of the terrace. After placement on the terrace, each seat is individually attached to the terrace by a screw from the center of the seat. In addition, the seat surface is contoured and designed to allow optimum occupation of the space available to provide added comfort to the occupant. This seat design solves the problem of mounting seats along the curvature of a stadium, but is restricted to mounting at the edge of a solid platform. This restriction is too limiting because a solid platform may not always be available, or such mounting may not meet modern construction codes.

U.S. Pat. No. 3,466,097 issued to Motter offers a modular seating combination which employs a series of seat modules combined and connected into rows by connector modules. Each seat module is designed to accommodate a single person. The seating modules have a compound curved shape and some flexibility to afford added comfort. Such construction satisfies the needs for comfort and regular demarcation of assigned seats, but they are expensive and difficult to install. Additionally, the seat modules are designed to form straight rows, and hence will not conform well to the curvature of seating rows found in many stadium designs.

U.S. Pat. No. 4,490,949 issued to Sutter et al. and U.S. Pat. No. 4,518,199 issued to Lewis each disclose a molded plastic seating module for a single occupant comprising a contoured, upper seating surface, a sloped front surface and a hollow base. The ends of adjacent seats interlock by an insert housing of one seat module that fits tightly within a corresponding open receptacle of an adjacent seat module. Lewis suggests that the interlocking can be further secured by connecting pins inserted through holes provided on the interlocking parts. The system disclosed therein is an improvement for its simplicity of assembly, but is not designed or adapted for mounting to conform to the curvature of stadiums and amphitheaters.

U.S. Pat. No. 4,790,594 issued to Temos discloses a modular stadium seating assembly including side-by-side modular seat units mounted on a support framework by clamping adjacent edge portions of adjacent seat units between a clamp-down member and the support framework. The clampdowns mark the demarcation between seats but also take up surface area, which if left as seating surface, could enhance the seating comfort of the occupant.

There therefore remains a need for a stadium seating system that optimally utilizes the space available for seating purposes and can be mounted in curved sections of stadiums. The present invention is directed toward meeting this need.

SUMMARY OF THE INVENTION

The present invention is a modular seating system for use in a tiered stadium. Each seat module is of a one piece molded plastic construction, having interlocking means for assembly in a side-by-side relationship in rows with each seat module attached through the interlocking means to a support understructure. The interlocking means comprise tabs and blind rabbets, and each interlocking means contain openings for receiving fasteners. The openings on the tabs include sufficient play to allow lateral and rotational movement when assembling the seating system in order to accommodate the geometry of existing stadium, in particular, curved sections of the stadium. Additionally, the interlocking design and method of attachment allow the entire width of the upper surface to be available for seating purposes.

The seating system of the present invention provides unique features enabling stadium management to solicit donations and display advertisements. A recessed area is molded onto the back surface of each seat module for receiving donor or advertising plates as a fund raising avenue. An end cap adapted for attachment to the end of each seating row also provides a space for the placement of advertisement plates or other emblems such as a full multicolor logo. The seat module may be further characterized by its ergonomic design. The sitting surface uses complex curves and rounded edges to reduce sitting stresses. For added comfort, the bottom of the seat modules also incorporates curved surfaces that mate with the top when it is deflected downward by the weight of an occupant. In a further preferred embodiment, the present invention is characterized by its "wood bench-type" appearance. Each seating module is shaped to provide a wood slat appearance and the seat surface has a wood grain texture. Bolts with large, visible heads may be used to enhance the appearance of wood bench seating. Furthermore, the seat modules are available in different dimensions and colors for adaptation to specific requirements of individual stadiums.

It is therefore a principal object of this invention to provide improved individual stadium seats that satisfy all current U.S. National construction codes at an affordable price.

Another object of the present invention is to provide stadium seating which is designed for optimum utilization of the space available. The interlocking design and mounting system of this invention allows the full width allocated for each seat to be used for sitting. Additionally, the interlocking design simplifies installation by eliminating the need for a separate clampdown for each seat.

An additional object of this invention is to provide stadium seating which can be mounted to conform to the curvature of stadiums and amphitheaters to give a pleasing, gentle curve along the length of a row.

A further object is to provide stadium seating which can be fitted to existing common supporting understructures of varying widths and depths.

A yet further object is to provide donor or advertising plates on the back of each seat as a fund raising avenue. This option is not available on prior art designs.

A still further object is to provide a modular seating system which is adaptable to different mounting environments and hence gives some flexibility during installation.

Related objects and advantages of the present invention will become more apparent by reference to the following figures and detailed description.

DETAILED DESCRIPTION OF THE PREFERRED EMBODIMENT

Figure 1:
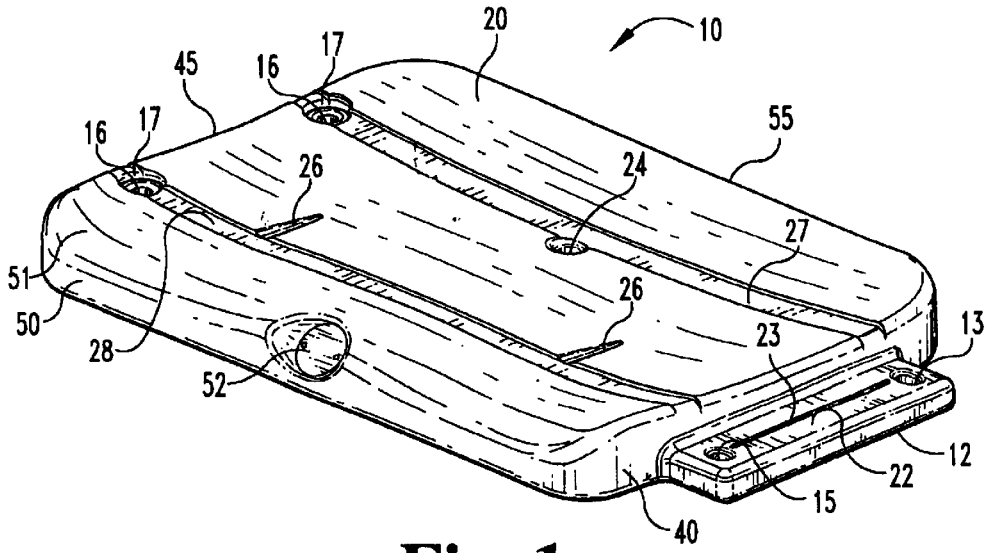
FIG. 1 is a perspective view of a first embodiment of an interior seat module of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended. Any such as alterations and further modifications in the illustrated device, and any further applications of the principles of the invention as illustrated therein being contemplated as would normally occur to one skilled in the art to which the invention relates are also included.

An embodiment of the interlocking seating system of the present invention as shown in FIGS. 1–15 consists of interior seat modules 10 (FIG. I) and aisle seat modules 60 (FIG. 10) mounted on a support understructure. The interior seat module 10 is used in all seat positions except as the end seat at the right end of each row (as viewed facing the front edge of the row), where an aisle seat module 60 is used. The seat modules can be of any depth (front to back) and width (left to right) to fit the existing architecture of the stadium. The embodiment as shown is 12 inches (12") deep and approximately 18" wide. In another embodiment of the present invention, the seat modules are 10" deep. These narrower seat modules are designed for use on a narrow common supporting structure where the use of deeper seat modules may cause the available egress to not meet existing building codes. Except for the differences in the seat dimension, all other features included in the illustrated embodiments are included in the narrower seat modules. Thus, the above description of the specific features concerning the 12" seat modules 10, 60 are also applicable to the narrower seat modules. It will be appreciated that the features of the present invention may be incorporated into seats having any depth dimension.

The seat modules 10, 60 may be formed from any materials having sufficient strength, durability and moldability, and are preferably formed from polymer plastics, for example, high or low density polyethylene. In one embodiment, the seat modules are of one-piece construction molded from a linear low density polyethylene plastic polymer.

Figure 2:
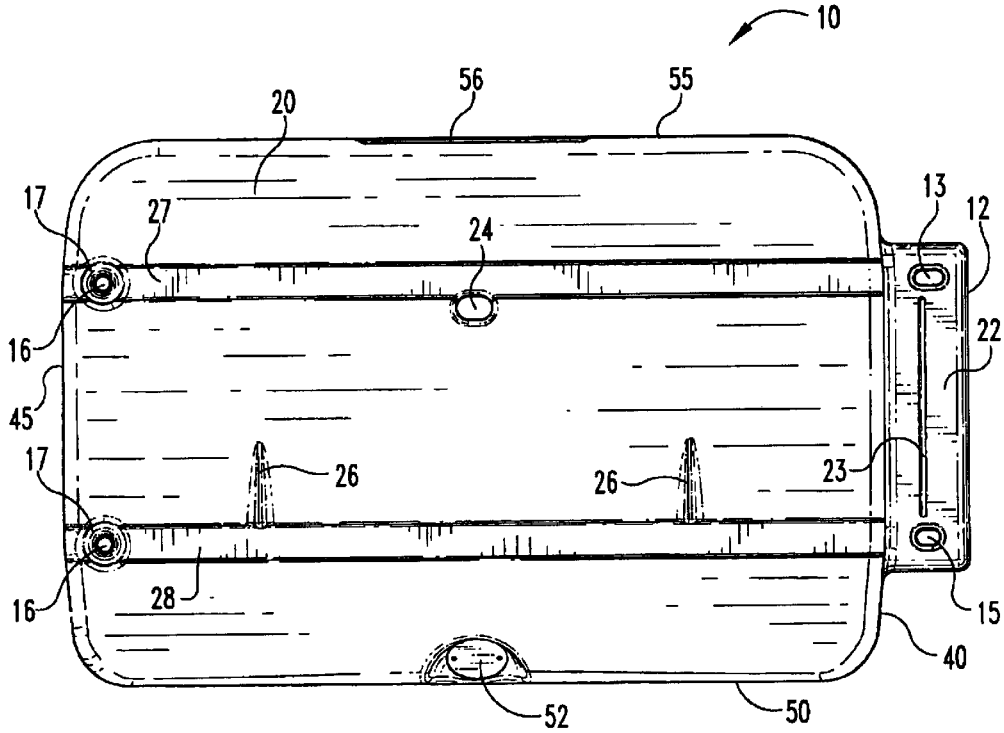
FIG. 2 is a top plan view of the interior seat module of FIG. 1.
Figure 3:
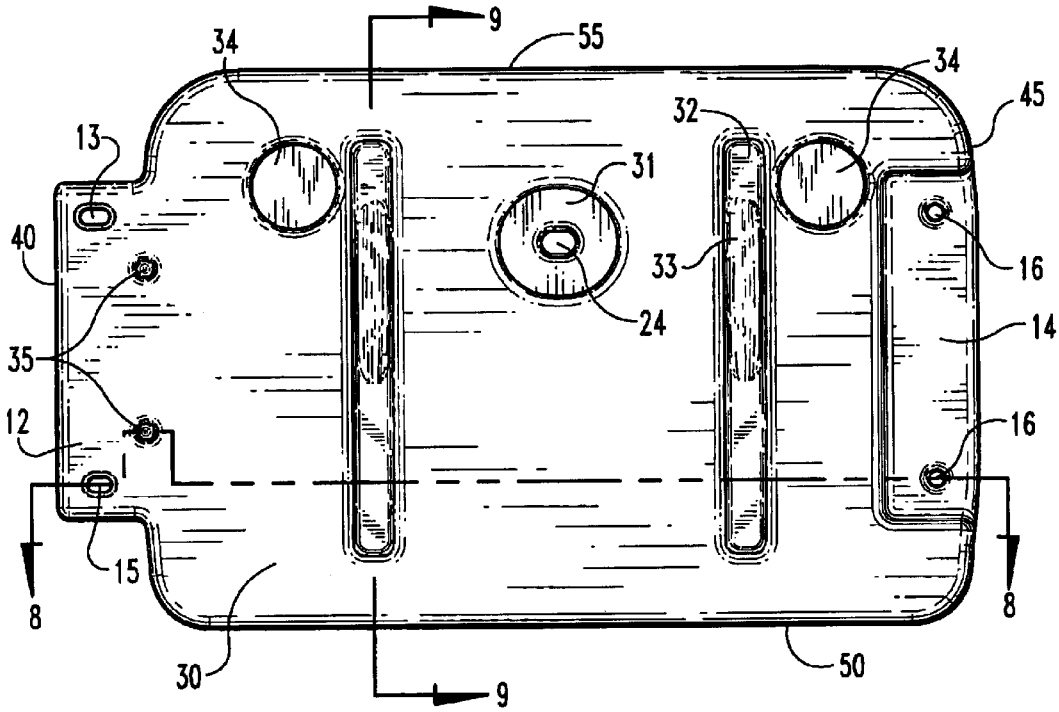
FIG. 3 is a bottom plan view of the interior seat module of FIG. 1.
Figure 4:
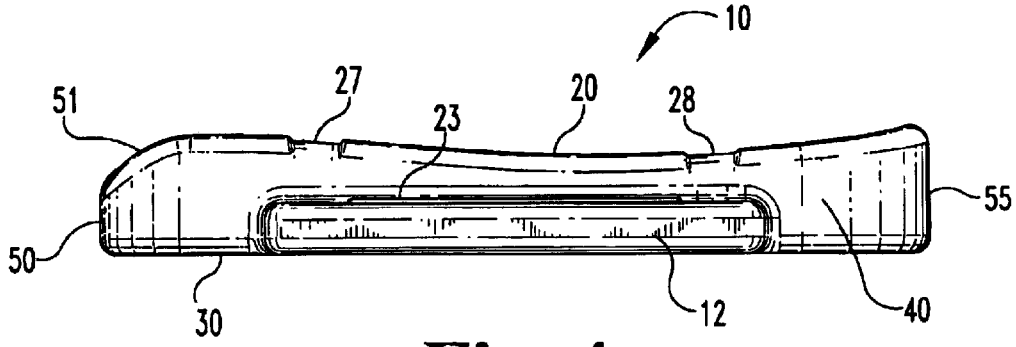
FIG. 4 is a right side elevation view of the interior seat module of FIG. 1.
Figure 5:
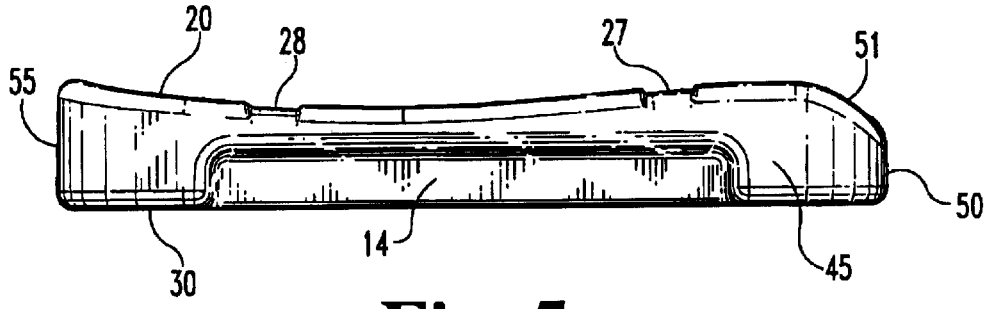
FIG. 5 is a left side elevation view of the interior seat module of FIG. 1.
Figure 8:
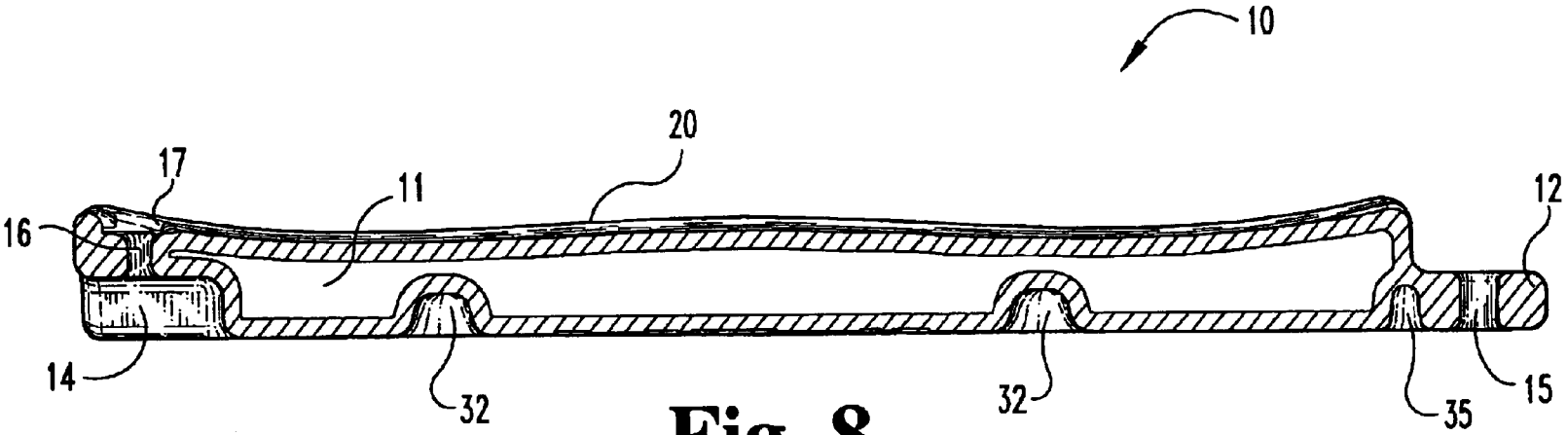
FIG. 8 is a sectional view taken along line 8—8 in FIG. 3.

Referring to FIGS. 1–5, interior seat module 10 comprises a hollow body member of generally rectangular shape having a top 20, a bottom 30, a right side 40, a left side 45, a front 50, and a back or rear 55, which collectively enclose an interior cavity 11 (see FIG. 8). The interior seat module 10 includes interlocking or engaging means. The interlocking means include openings adapted to receive fasteners for securing the interlocked seat modules 10, 60 to a supporting understructure. In the illustrated embodiment, the engagement means comprise a tab 12 protruding from the right side 40 and a blind rabbet 14 recessed into the left side 45. Blind rabbets 14 are adapted to receive tab 12 of an adjacent seat module 10. FIGS. 4 and 5 give an end-on perspective of tab 12 and blind rabbet 14, respectively. The openings included in blind rabbets 14 are apertures 16. Apertures 16 further include counterbores 17 to allow the heads of fasteners to lie flush with or below top surface 20 of seat module 10. The openings included in tab 12 are elongated apertures or slots 15 and 13 disposed through its front and back portions, respectively. Elongated apertures 13 and 15 are larger than apertures 16 to allow lateral movement of adjacent seat modules relative to each other. In addition, the elongation of elongated aperture or slot 13 is preferably longer than elongated aperture or slot 15 to allow adjacent seat modules to rotate at a slight angle (if necessary) in order to create a curved row of seats. Tab 12 includes a top surface 22 upon which a rib 23 is disposed. When mounted, rib 23 impinges into the contacted surface of blind rabbet 14 into which it fits, thus providing frictional resistance to movement of the installed seat modules 10, 60.

Figure 6:
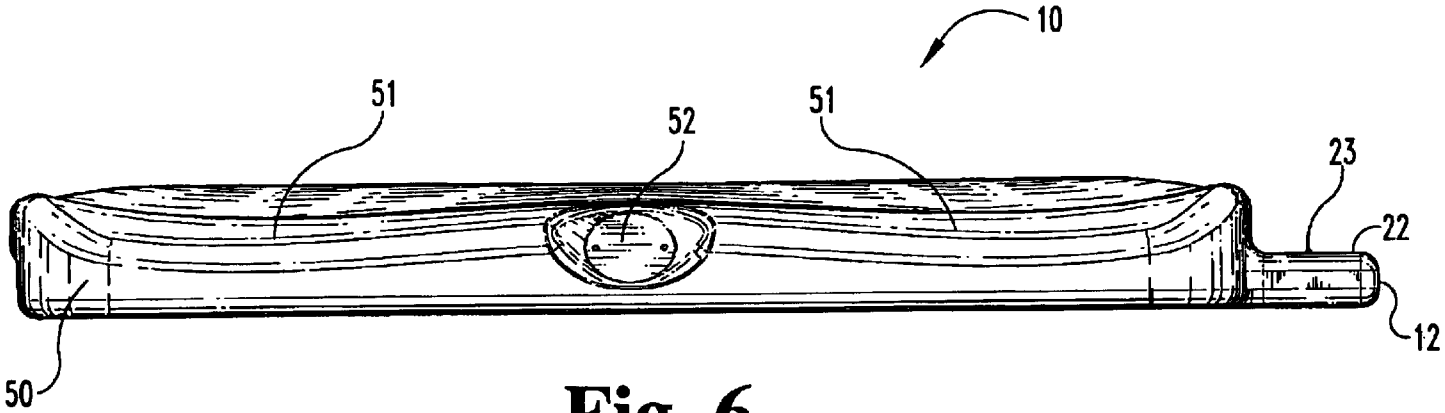
FIG. 6 is a front elevation view of the interior seat module of FIG. 1.
Figure 9:
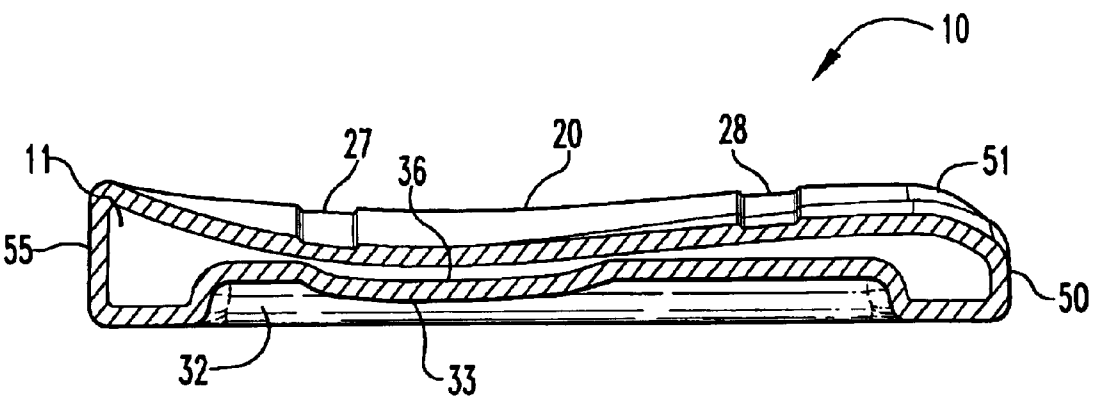
FIG. 9 is a sectional view taken along line 9—9 in FIG. 3.
Figure 10:
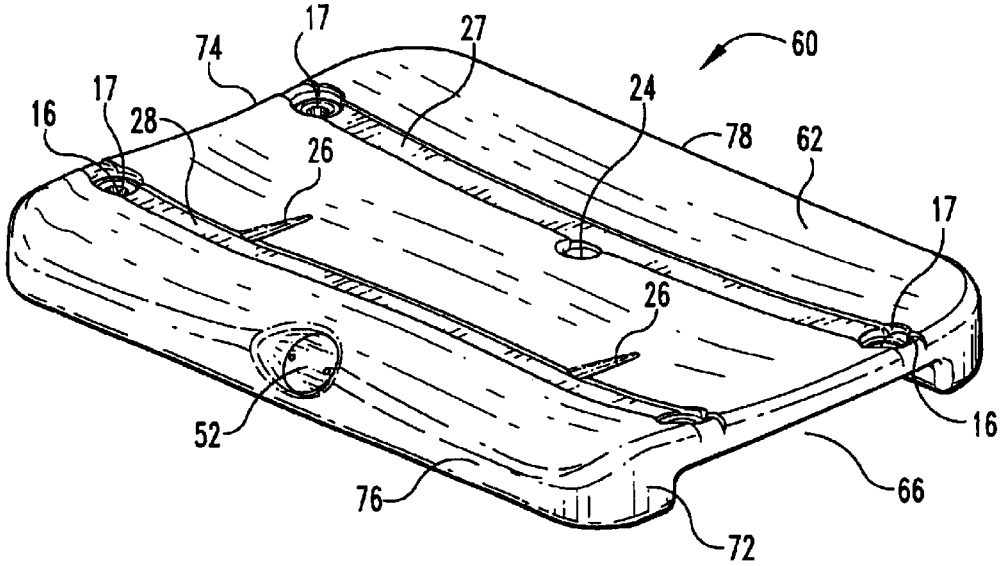
FIG. 10 is a perspective view of an aisle seat module of the present invention.
Figure 11:
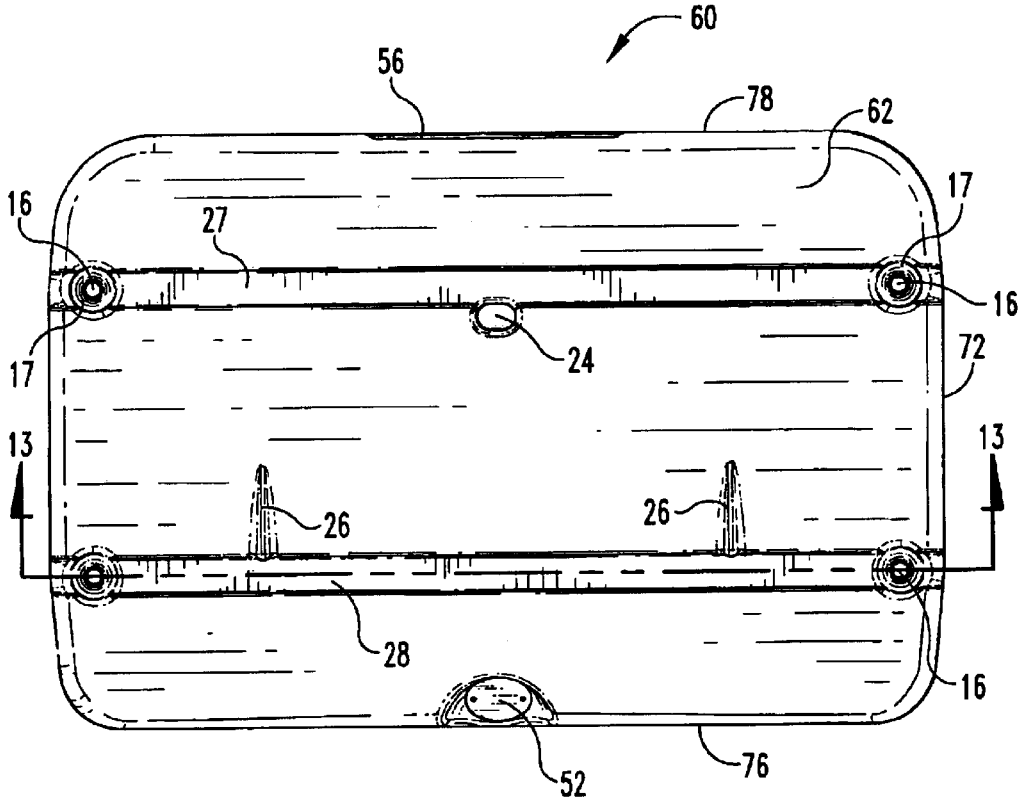
FIG. 11 is a top plan view of the aisle seat module of FIG. 10.

As seen in FIG. 1, the interior seat module 10 is contoured according to ergonomic principles to provide maximum support and comfort and reduce sitting stresses on the occupant. The top surface 20 is sculpted with complex curves both in the antero-posterior direction and in the lateral direction perpendicular thereto. These curved surfaces provide better support to the occupant and hence reduce stress on the lower back and upper legs. As seen in FIGS. 4, 5, and 6, the top edge 51 of the front 50 of the interior module 10 has a complex waterfall curve for reducing peak pressure under the occupant's leg. Another feature of the seat modules 10, 16 which adds comforts to the occupant is disposed within troughs 32. As seen in FIGS. 3, 8 and 9, troughs 32 extend front to back across the bottom surface 30 and into enclosed interior cavity 11 and act as a stop when the top 20 is deflected downward by the weight of the occupant. Referring to FIG. 9, the longitudinal profile of the bottom of the trough is not flat. Disposed within troughs 32 are elongated raised convex sections 33 having corresponding concave surfaces 36 within the enclosed interior cavity 11. So, when top 20 is deflected downward meeting concave surfaces 36, the contour of concave surfaces 36 conform better to the body shape, thus providing added comfort to the occupant.

The interior seating modules 10 can also optionally be styled to have a "wood bench-type" appearance. The grooves 27, 28, as shown in FIG. 1, already simulate gaps between wood boards and wood grain texture can be disposed upon the top surface 20 to achieve the appearance. To complete the appearance of wood bench seating, bolts with large heads may be used to attach the seat to the understructure.

To avoid accumulation of water on the surface of the seat module 10, a drain 24 is provided to enable water to leave the contoured seat surface 20. Referring to FIG. 2, drain 24 is located in a low spot of the contoured seat surface 20 just below groove 27. A pair of notches 26 cut into the side of the groove 28 direct water from groove 28 to run downwardly and be received by drain 24, thereby allowing water that lands on the seating surface 20 to escape.

Referring to FIG. 3, the interior seating module 10 also incorporates structural features or reinforcement means, such as shallow cylindrical depressions 31 and 34, dimples 35, and troughs 32 disposed on the bottom 30 of interior seat module 10, to provide added strength and rigidity. Shallow cylindrical depression 31, encircling drain 24 on the bottom surface 30, is designed to add structural rigidity to drain 24. Shallow cylindrical depressions 34 disposed on bottom surface 30, near the back 55, a location where most of the stress from the weight of the occupant would be, are designed to add strength to interior seating module 10. Dimples 35, disposed on the bottom surface 30 near the junction where tab 12 protrudes from the right side 40, add structural rigidity to the junction between tab 12 and the seat proper. Troughs 32 extend front to back across the bottom surface 30 and are also designed to add structural rigidity to the entire interior seat module 10.

Referring to FIG. 1, a recessed area 52, located centrally at top edge 51 of front surface 50 of each interior seat module 10, is provided for displaying a seat number. Recessed area 52 is preferably tilted slightly toward top surface 20 for easy viewing.

Figure 7:
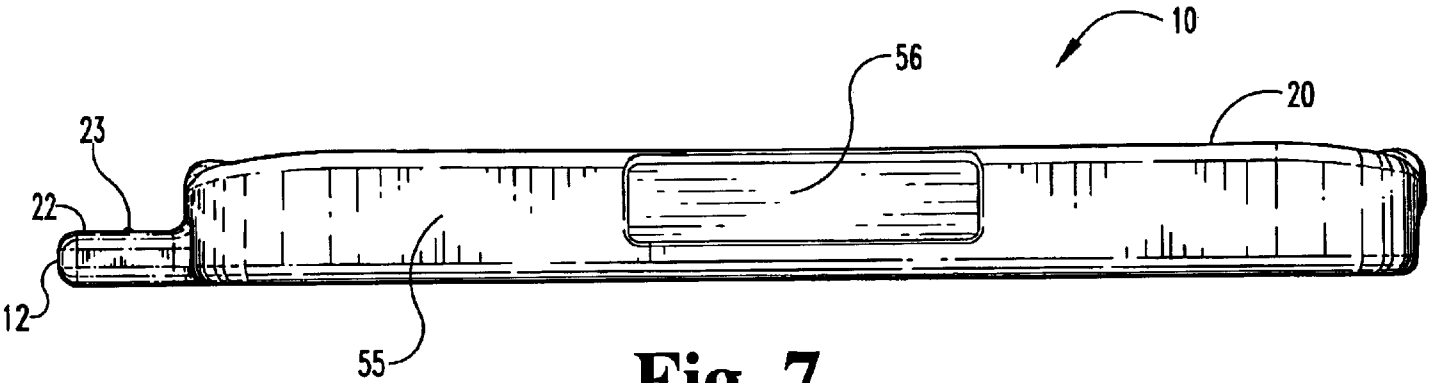
FIG. 7 is a back elevation view of the interior seat module of FIG. 1.

The seating system of the present invention also provides unique features enabling stadium managers to solicit donations and display advertisements. As seen in FIG. 7, a recessed area or space 56 on back 55 of each interior seat module 10 provides a space for donor or advertising plates (not shown). Recessed area 56 is tilted slightly upwards (toward top surface 20) for easy viewing of the plates. The ability to recognize a donor makes each seat a potential fundraiser; likewise, the opportunity to display advertisements also provides revenue potential. This option is not currently available on other products within this market.

Figure 12:
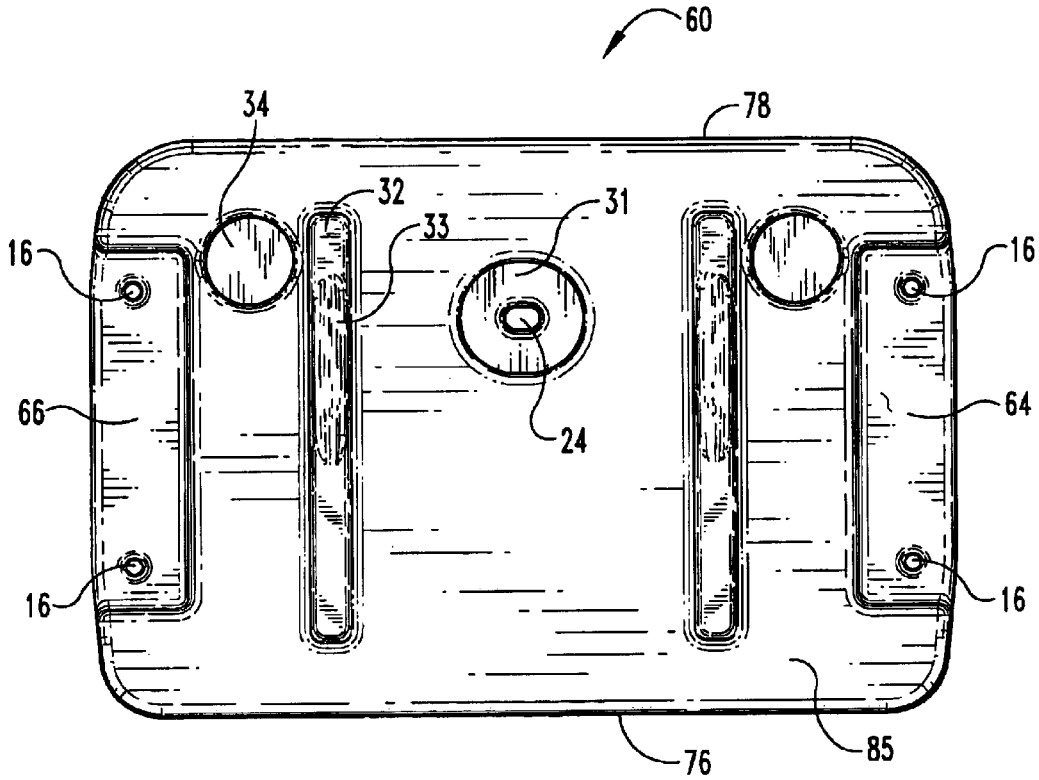
FIG. 12 is a bottom plan view of the aisle seat module of FIG. 10.
Figure 13:
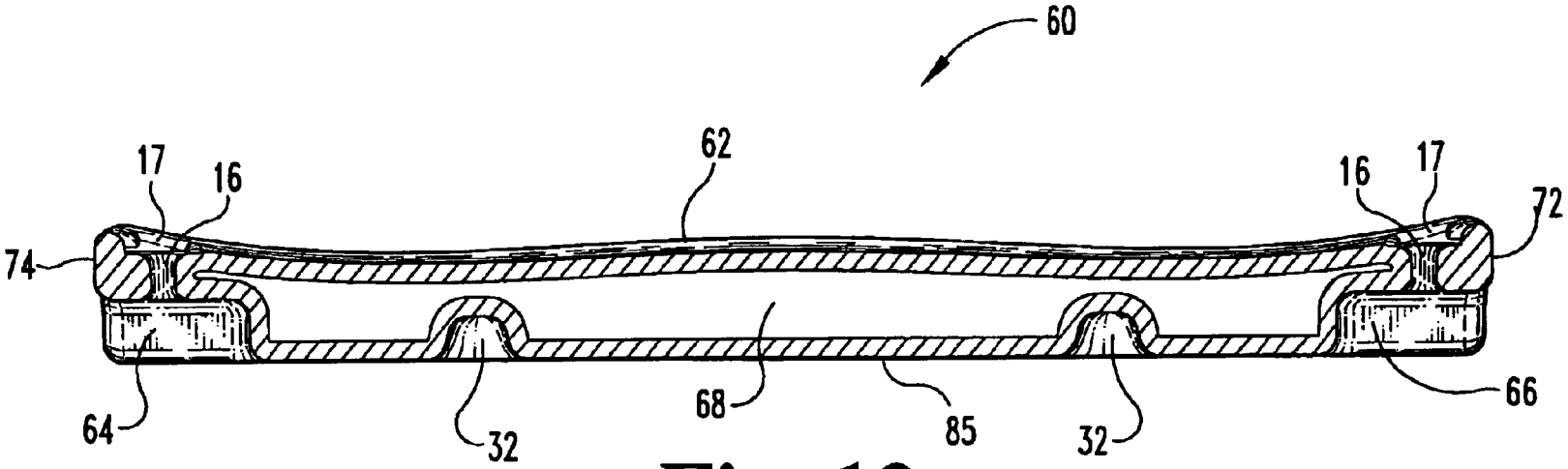
FIG. 13 is a sectional view taken along line 13—13 in FIG. 11

FIGS. 10–13 show an aisle seat module 60 having a top 62, a bottom 85, a right side 72, a left side 74, a front 76, and a back 78, which collectively enclose an interior cavity 68 (FIG. 13). Referring to FIG. 12, aisle seat module 60 includes interlocking means comprising two blind rabbets 64 and 66 opposingly disposed on the left and right sides, respectively, when viewing from the front of aisle seat module 60. In this illustrated embodiment of the interlocking seating system, the left blind rabbet 64 is adapted to interlock with tab 12 of an interior seat module 10 placed immediately to its left. The right blind rabbet 66 is adapted to mount on the supporting understructure as described hereinbelow.

Except for the difference in interlocking means discussed above, all other features included in the two seat modules 10, 60 are the same. Thus, the above description of specific features on the interior seat module 10 is also applicable to aisle seat module 60.

Figure 14:
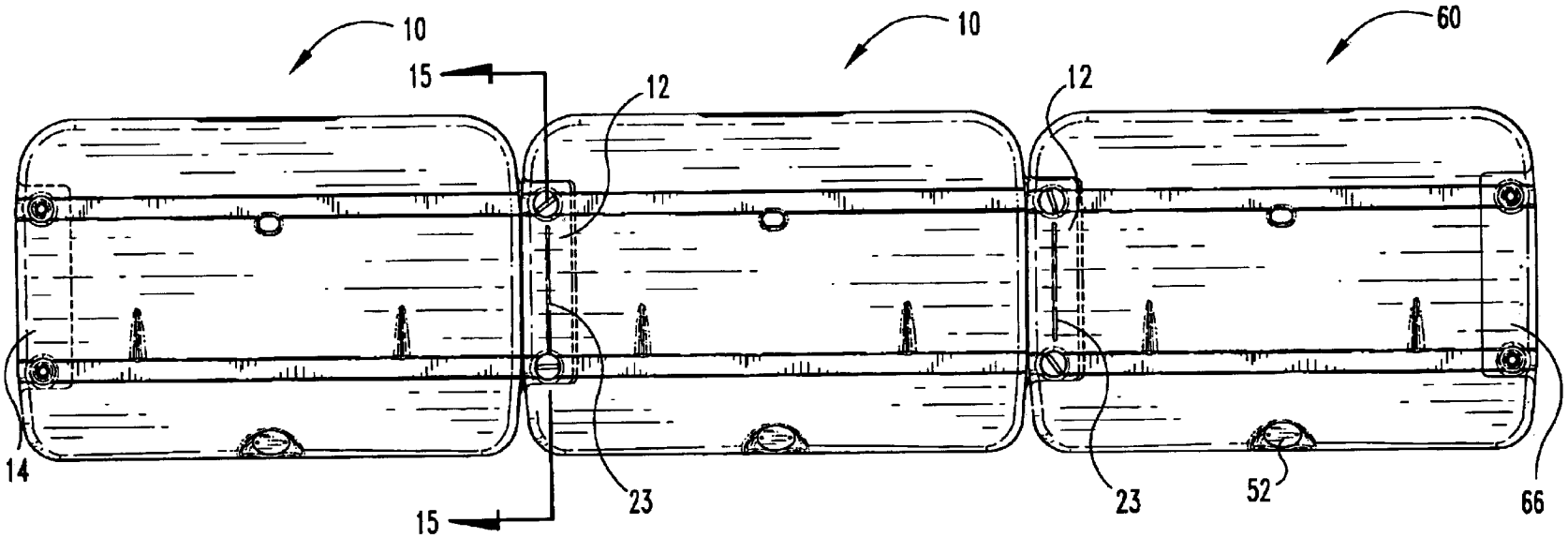
FIG. 14 is a top plan view of an interior seat module of FIG. 1 interlocking, at a first side, with another interior seat module of FIG. 1 and, at a second side, with an aisle seat module of FIG. 10.

In the illustrated embodiment of the interlocking seating system of the present invention, the seat modules 10, 60 are installed over aluminum bleachers. Referring to FIG. 14, seat modules 10, 60 are assembled into rows by sliding blind rabbet 14 of one interior seat module 10 over tab 12 of an adjacent interior seat module 10. Upon reaching the end seat position, an aisle seat module 60 is used. The length of the rows can be adjusted. Each pair of seat modules can be pushed together or pulled apart due to the elongation of the elongated apertures 13 and 15. This overall length adjustment can be substantial considering the adjustment gain between two seat modules is multiplied by the total number of seat modules 10, 60 in the row. The placement of the seat modules 10, 60 can also deviate from a straight line. Due to the difference between the elongation of elongated apertures 13 and 15, each pair of seat modules 10 can be placed at a slight angle relative to each other. When the individual seat modules are mounted in this way, the overall effect produces a pleasing gentle curve along the entire length of a row and accommodates installation in curved sections.

Figure 15:
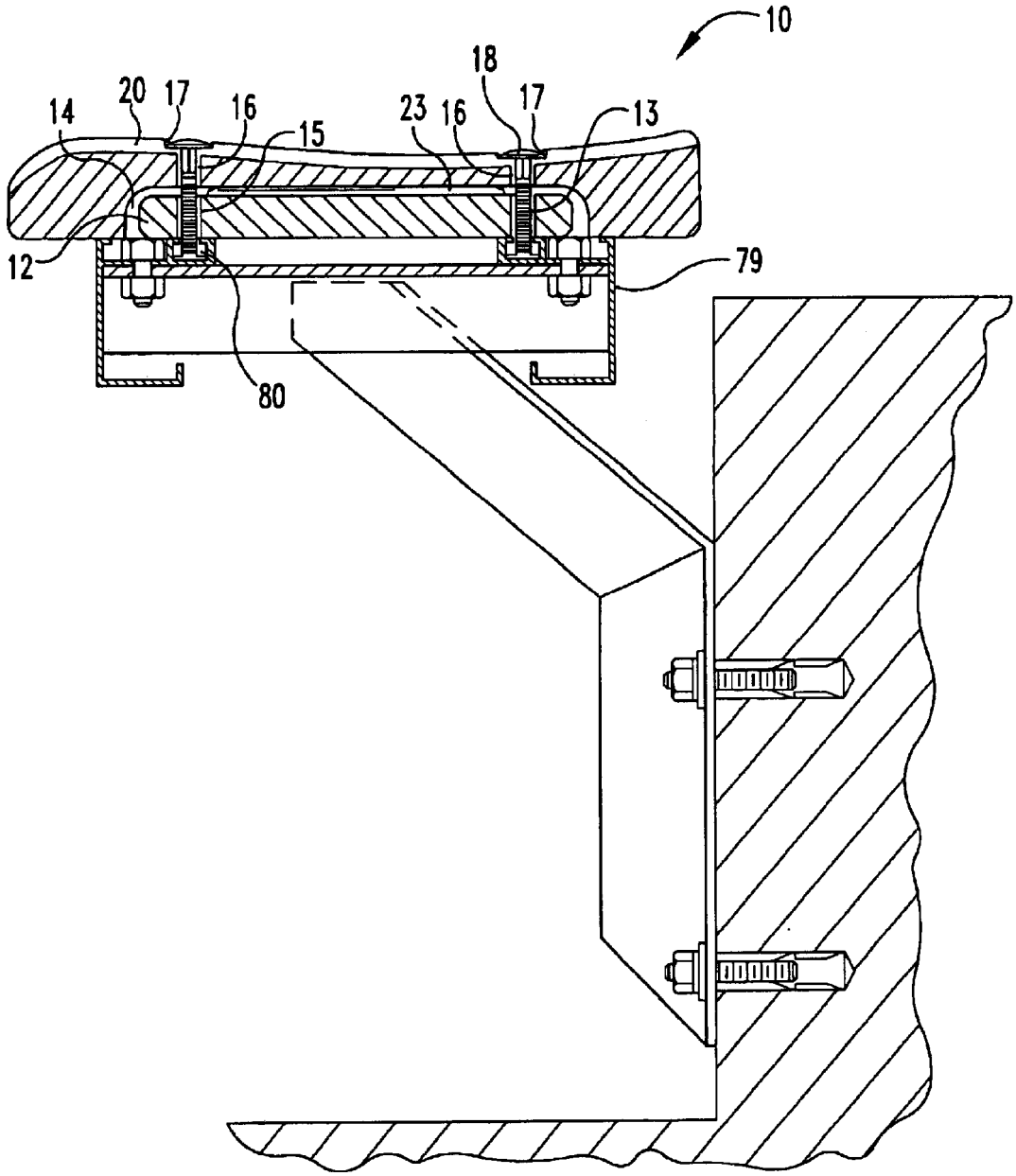
FIG. 15 is a sectional view taken along lines 15—15 in FIG. 14 of the interlocking system assembled, and additionally showing the attachment to an existing aluminum bleacher.

Referring to FIG. 15, at each interlocking junction, apertures 16 of one interior seat module 10 are aligned with elongated apertures or slots 13 and 15 of the adjacent interior seat module 10. Two bolts 18, passing through the aligned apertures 13, 15 and 16, secure the seat modules 10 to the existing aluminum bleacher 79 with a receiving nut 80. It may be appreciated that installation of the seating system is extremely simple, requiring only the securing of two bolts 18 for each seat module 10, 60. The head of the bolt 18 completely fits within the counterbore 17, thus leaving the entire upper surface of the seat module for sitting.

Figure 16:
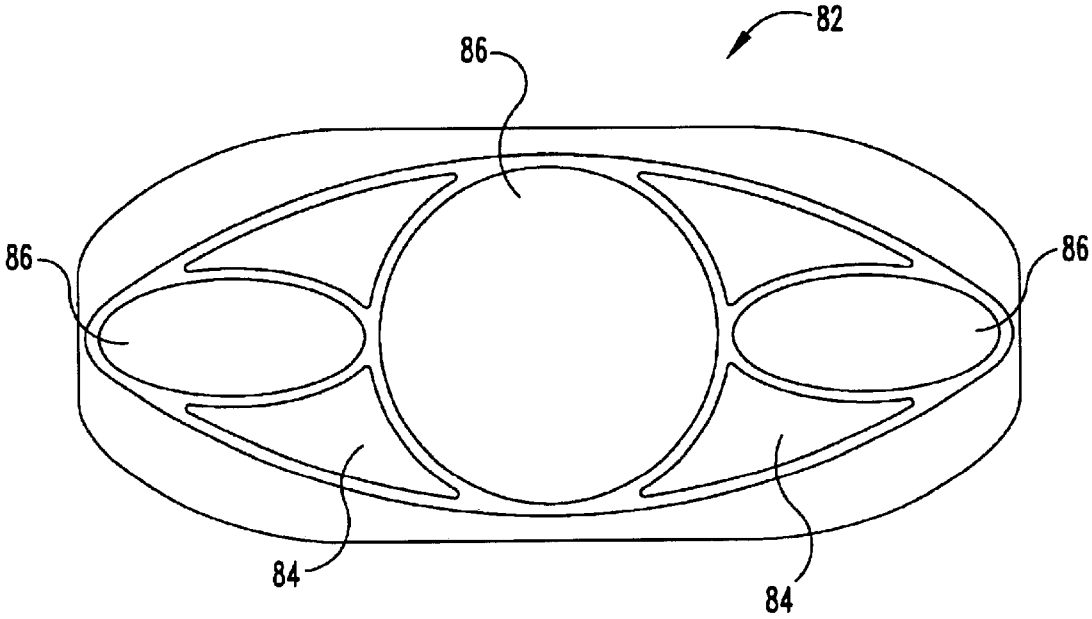
FIG. 16 is a top plan view of an end cap for placement at the end of a seating row adjacent an aisle.

To provide a finished look to the seating rows, end caps 82 are provided. End cap 82 is adapted for attachment to the common understructure adjacent to the aisle of each seating row. End cap 82 provides a space for the placement of lettering plate to display row numbers, and also for advertisement plates or other emblems such as a full multicolor logo. As seen from FIG. 16, the surface of end cap 82 is sculpted with rises 84 and depressions 86 to define areas for receiving the plates and emblems. End cap 82 is preferably made of aluminum, but other suitable materials may be used.

Figure 17:
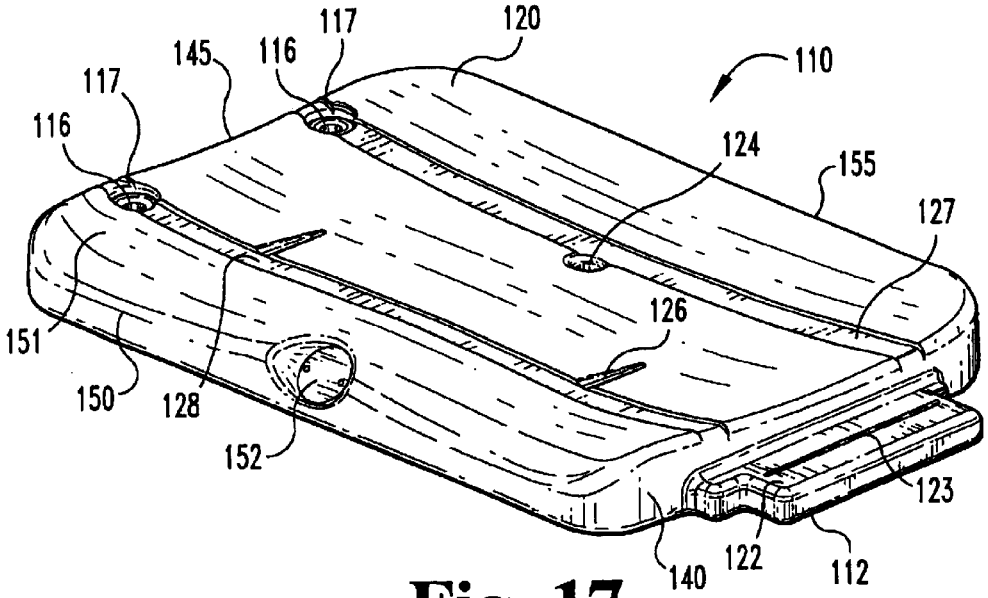
FIG. 17 is a perspective view of a second embodiment of an interior seat module of the present invention.
Figure 18:
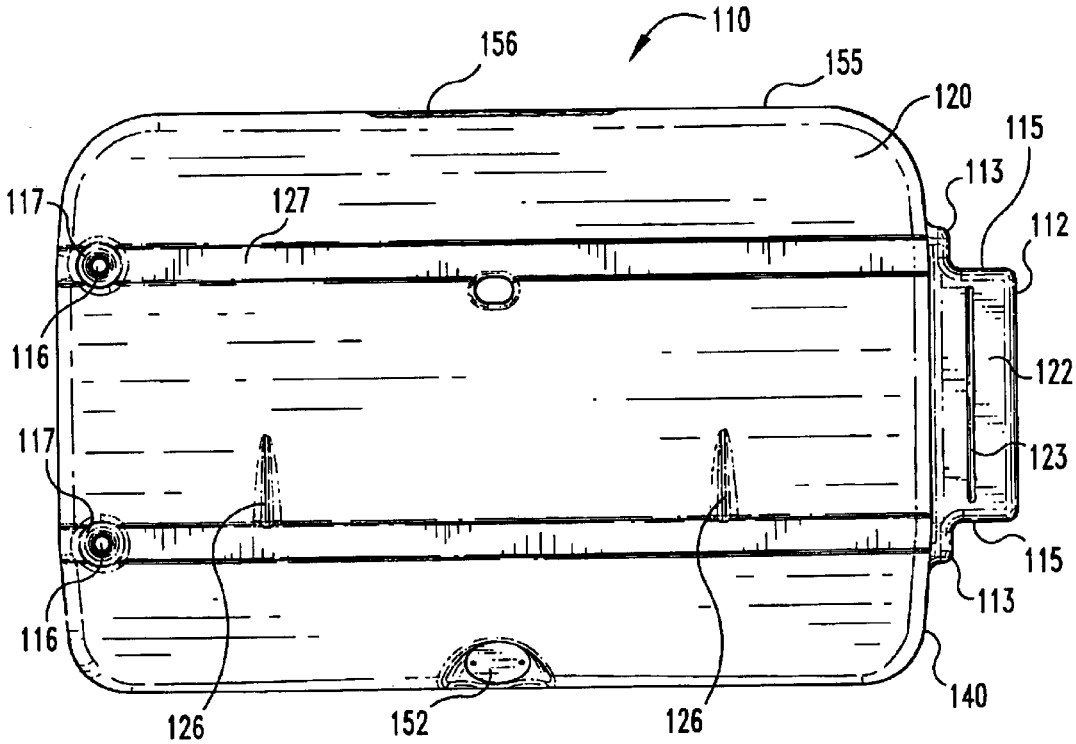
FIG. 18 is a top plan view of the interior seat module of FIG. 17.
Figure 19:
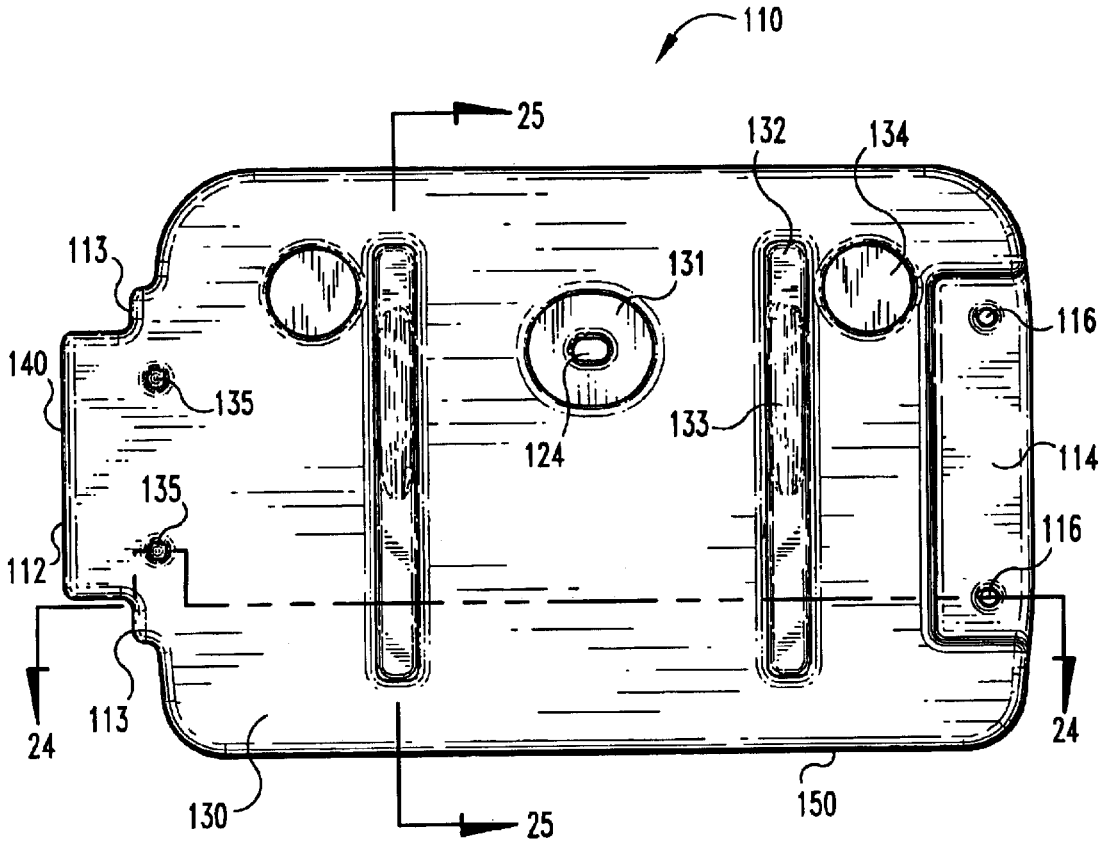
FIG. 19 is a bottom plan view of the interior seat module of FIG. 17.

The present invention further contemplates a second embodiment of an interior module 110 as depicted in FIGS. 17–25. All aspects of this second embodiment of interior seat module 110 is the same as interior seat module 10 except, instead of elongated slots 13, 15 defined through tab 12, tab 112 is clipped at both corners and defines a pair of notches 115. Referring to FIGS. 17–19, interior seat module 110 comprises a hollow body member of generally rectangular shape having a top 120, a bottom 130, a right side 140, a left side 145, a front 150, and a back or rear 155, which collectively enclose an interior cavity 111 (see FIG. 24). Interior seat module 110 includes interlocking or engaging means comprising a tab 112 protruding from the right side 140 and a blind rabbet 114 recessed into the left side 145. Blind rabbets 114 are adapted for receiving tab 112 of an adjacent seat module. Defining through blind rabbits 114 and tabs 112 are openings which are adapted to receive fasteners 118 for securing the interlocked seat modules 110 to a supporting understructure, for example, the aluminum bleacher 79 described hereinabove.

Figure 20:
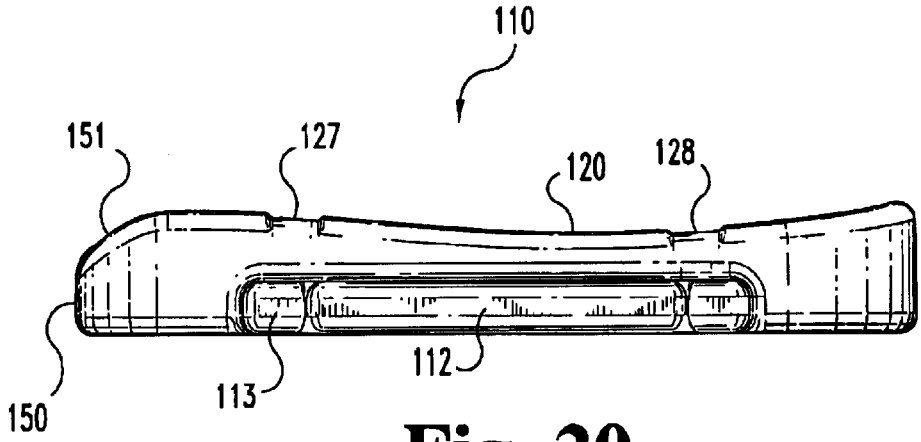
FIG. 20 is a right side elevation view of the interior seat module of FIG. 17.
Figure 21:
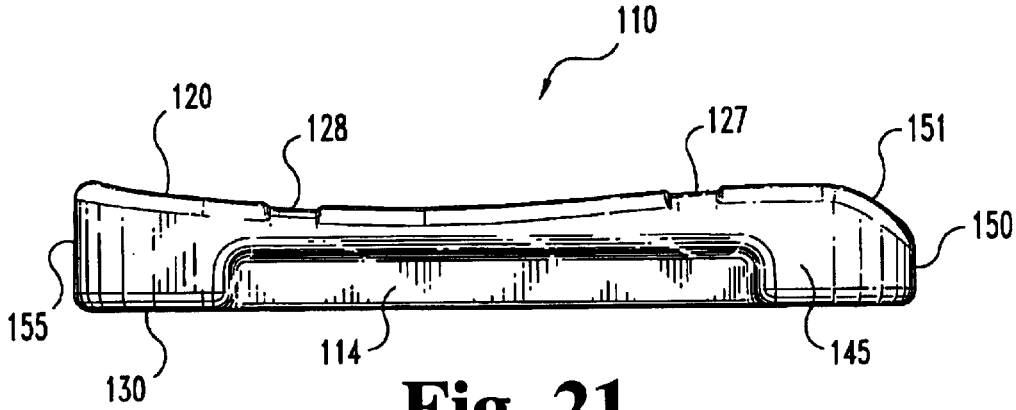
FIG. 21 is a left side elevation view of the interior seat module of FIG. 17.
Figure 22:
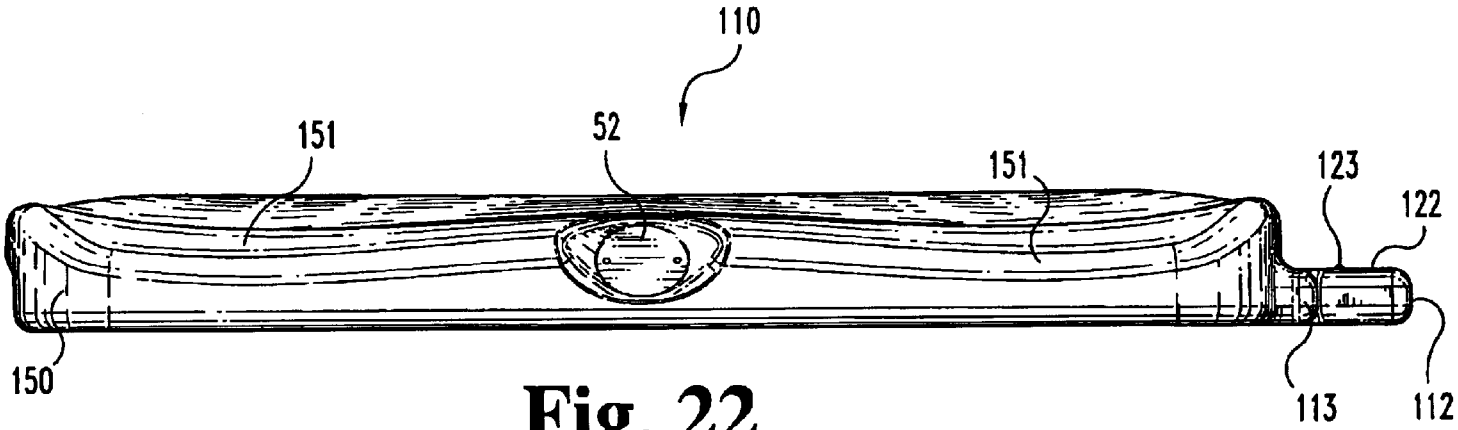
FIG. 22 is a front elevation view of the interior seat module of FIG. 17.
Figure 23:
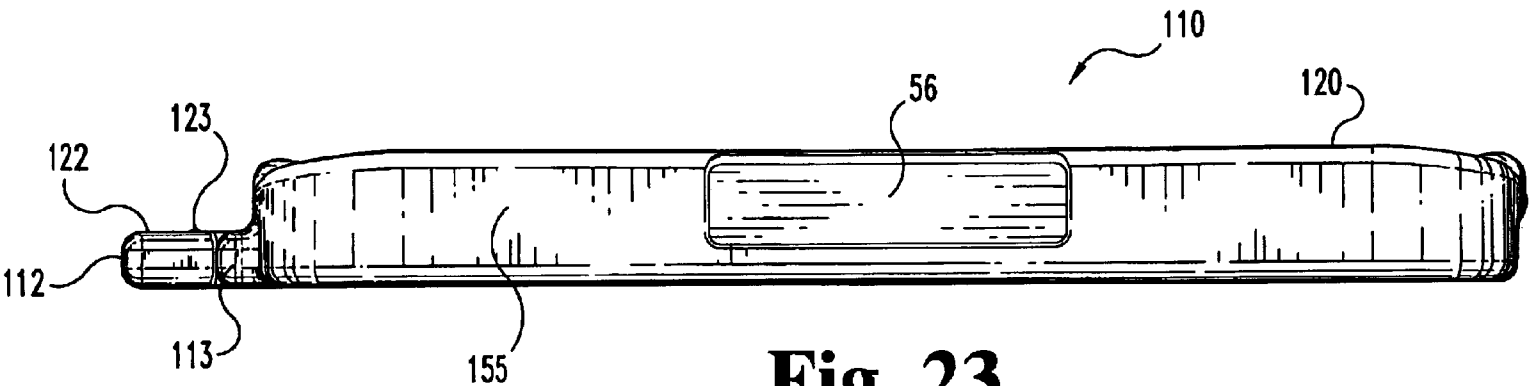
FIG. 23 is a back elevation view of the interior seat module of FIG. 17.
Figure 24:
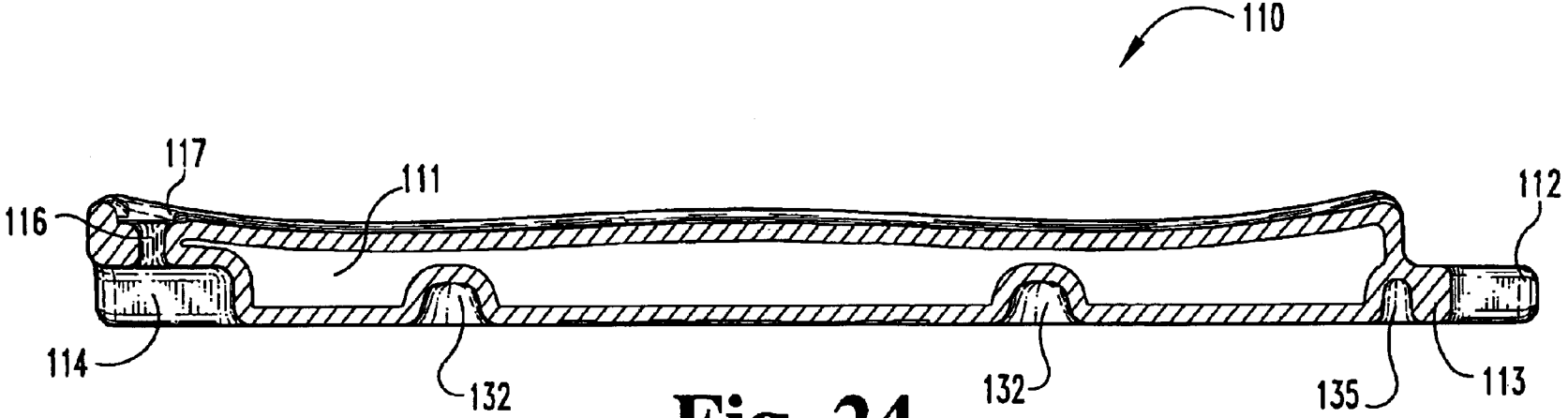
FIG. 24 is a sectional view taken along line 24—24 in FIG. 19.
Figure 25:
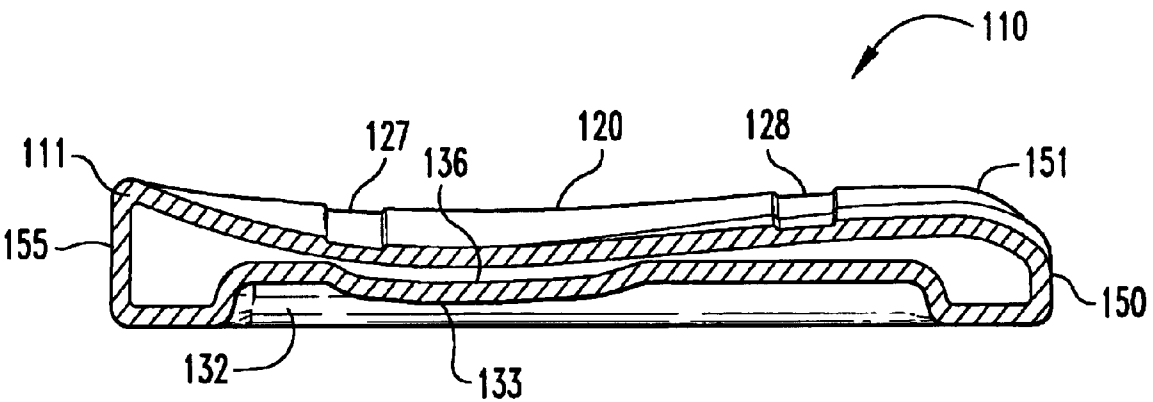
FIG. 25 is a sectional view taken along line 25—25 in FIG. 19.

FIGS. 20 and 21 give an end-on perspective of tab 112 and blind rabbet 114, respectively. The opening defined through blind rabbet 114 are apertures 116 (FIG. 19). Apertures 116 include counterbores 117 which allow the heads of fasteners 118 to lie flush with or below top surface 120 of seat module 110. The opening defined through tabs 112 are notches 115 located at both corners of tabs 112. Notches 115 allow lateral and rotational movement of adjacent seat modules relative to each other, specially allowing adjacent seats to rotate at an angle (if necessary) in order to create a curved row of seats. In contrast with interior seat module 10, in which the length of the elongated apertures 13 and 15 limits the degree of rotation between adjacent seat modules 10, notches 115 of interior module 110 have no confining boundaries, thus allowing a larger degree of rotational freedom between adjacent seat modules 110. Seat modules 110 thus can be adapted for placement in a stadium having a tight curvature. Tab 112 further includes a top surface 122 upon which a rib 123 is disposed. When adjacent seat modules 110 are positioned and mounted, rib 123 impinges into the contacted surface of the blind rabbet 114 into which it fits, thus providing frictional resistance to movement of the installed seat modules.

Figure 26:
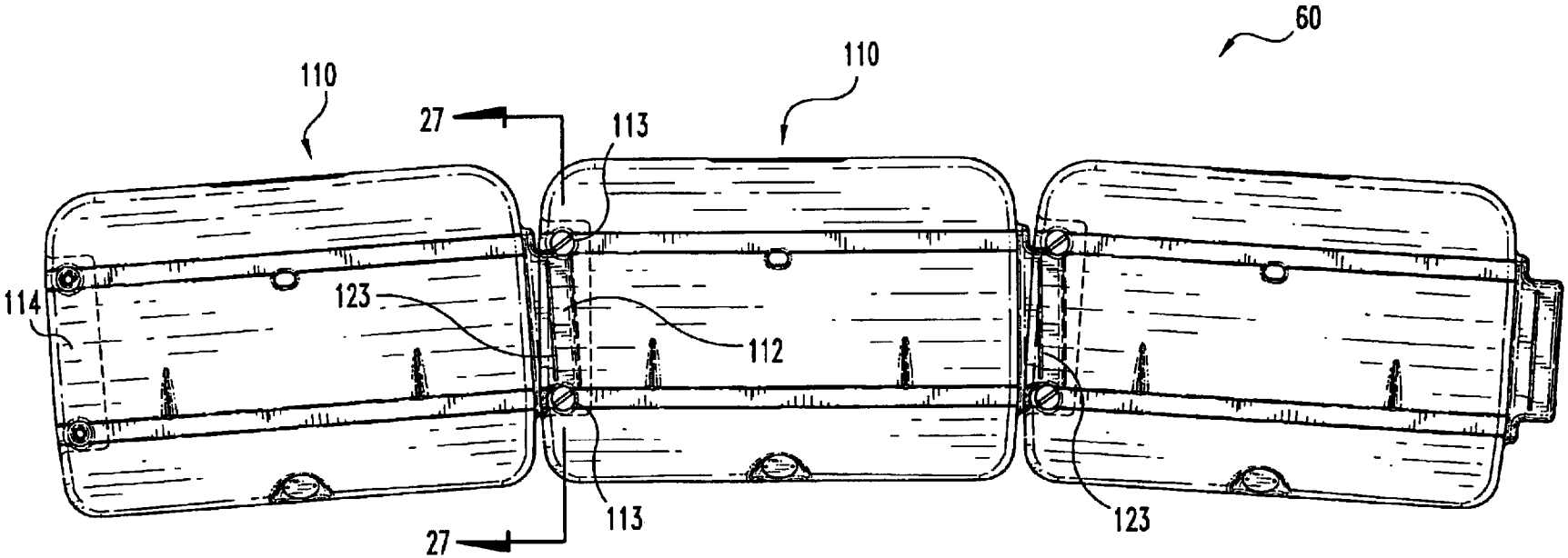
FIG. 26 is a top plan view of an interior seat module of FIG. 17 interlocking, at a first side, with another interior seat module of FIG. 17 and, at the second side, with an aisle seat module of FIG. 10.

Interior seat module 110 may be installed together with aisle seat module 60 over a supporting structure. Referring to FIG. 26, the seat modules 110, 60 are assembled into rows by sliding the blind rabbet 114 of one interior seat module 110 over tab 112 of an adjacent interior seat module 110. Upon reaching the end seat position, an aisle seat module 60 is used. The length of the rows can be adjusted. Each pair of seat modules can be pushed together or pulled. Preferably, the two adjacent seat modules 110 are so placed that rib 123 of tab 112 of the first seat module 110 is within contact of the underside of blind rabbet 114 of the second seat module 110, allowing rib 123 to bite into the underside of blind rabbet 114 when the fasteners 118 are tightened, thus maintaining the two adjacent seat modules 110, 60 in their relative position. This overall length adjustment can be substantial considering the adjustment gain between two seat modules is multiplied by the total number of seat modules 110, 60 in the row. The placement of the seat modules 110, 60 can also deviate from a straight line. The notch design allows adjacent modules 110, 60 to be placed at an angle relative to each other. When the individual seat modules are mounted in this way, the overall effect produces a pleasing gentle curve along the entire length of a row and accommodates installation in curved sections. Furthermore, due to the openness of notch 115, the adjacent seat modules 110, 60 have a high degree of rotational freedom relative to each other, and seat modules 110 are suitable for placement in a stadium having tight curvatures. Preferably, the adjacent seat modules 110, 60 are placed so that rib 123 of tab 112 is in contact with the underside of blind rabbet 114 such that when mounted, rib 123 can bite into blind rabbet 114 and fix the position of the adjacent seat modules 110, 60.

Figure 27:
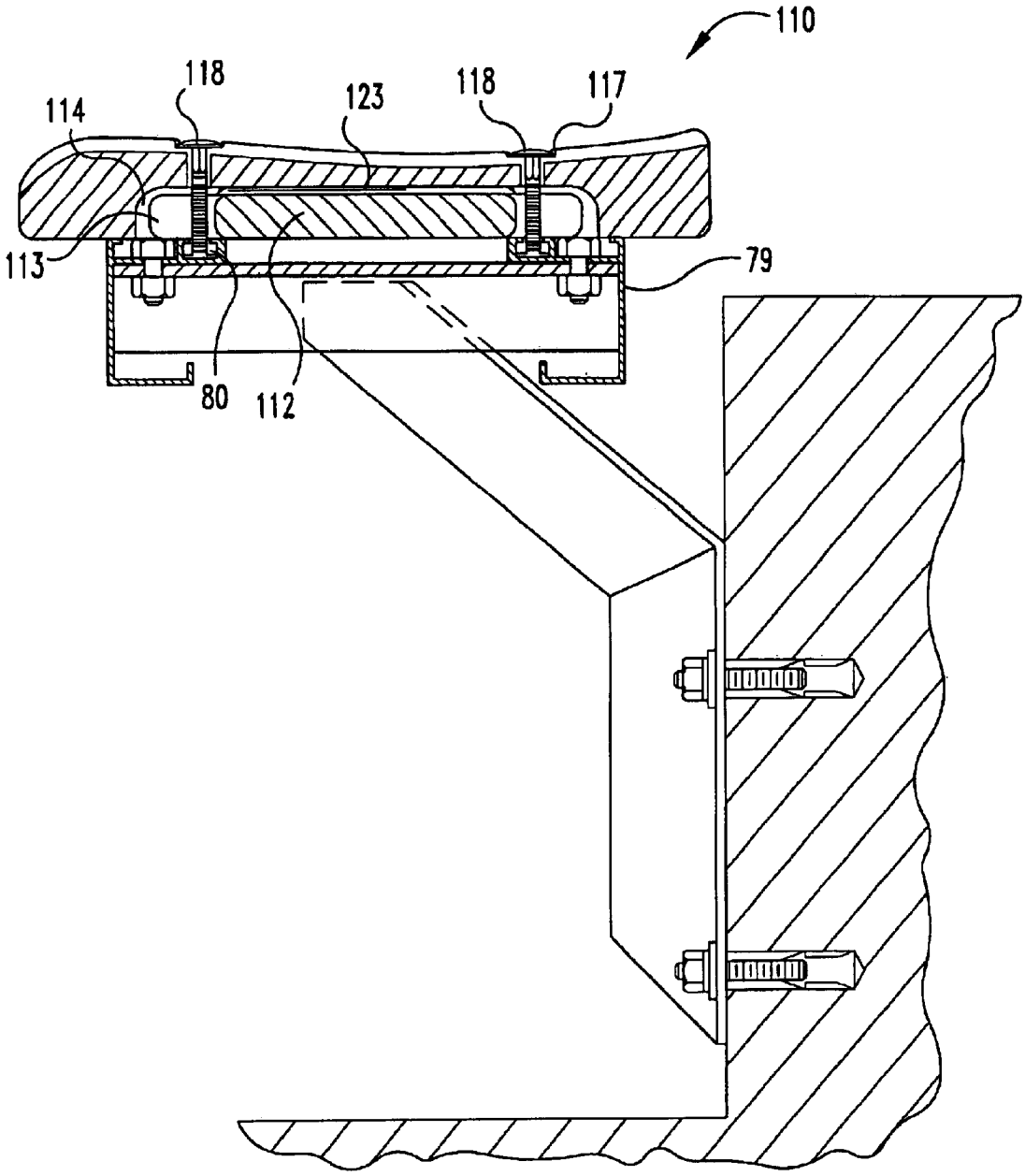
FIG. 27 is a sectional view taken along lines 27—27 in FIG. 26 of the interlocking system assembled, and additionally showing the attachment to an existing aluminum bleacher.

Referring to FIG. 27, at each interlocking junction, apertures 116 of one interior seat module 110 are aligned with notches 115 of the adjacent interior seat module 110. Two bolts 18, passing through the aligned apertures 116 and notches 115, secures the seat modules 110 to the existing aluminum bleacher 79 with a receiving nut 80. It may be appreciated that installation of the seating system is extremely simple, requiring only the securing of two bolts 118 for each seat module 110, 60. The head of the bolt 118 completely fits within the counterbore 117, thus leaving the entire upper surface of the seat module for sitting.

It will be understood that while an existing aluminum bleacher has been selected for the illustrative purposes in FIGS. 15 and 27 of this description, the use of this invention is not to be construed as being limited in this regard. This seat has been designed to be mounted on existing wood planks or to be mounted for a new installation on an aluminum beam mounting system. Additionally, it is contemplated that the seating modules can be adapted for use with substantially any support structure that can be utilized in stadiums and the like.

While the invention has been illustrated and described in detail in the drawings and foregoing description, these are to be considered as illustrative and not restrictive in character, it being understood that only one preferred embodiment has been shown and described and that all changes and modifications that come within the spirit of the invention are desired to be protected.

What is claimed is:

1. An interlocking seating system comprising:

a support understructure;

a plurality of seat modules, each of said seat modules includes a body member having a first interlocking means and a second interlocking means respectively positioned on a first and an opposing second side of said body member; and, a plurality of fasteners;

wherein said first interlocking means is adapted to receive said second interlocking means, thereby allowing adjacent seat modules to interlock and be secured to said support understructure by said fasteners inserted through said interlocked interlocking means;

wherein said first interlocking means and said second interlocking means further include openings defined therethrough; and wherein said opening defined through said first interlocking means are of a different size than said opening defined through said second interlocking means to allow lateral and rotational motions between said interlocked adjacent seat modules.

2. An interlocking seating system comprising:

a support understructure;

a plurality of seat modules, each of said seat modules includes a body member having a first interlocking means and a second interlocking means respectively positioned on a first and an opposing second side of said body member; and a plurality of fasteners;

wherein the interlocking means of a first seat module is adapted to receive the interlocking means of a second seat module, thereby allowing two adjacent seat modules to interlock and be secured to said support understructure by said fasteners inserted through said interlocked interlocking means;

wherein said plurality of seat modules comprises interior seat modules and aisle seat modules, said interlocking means of said interior seat modules comprise a tab and a blind rabbet, and said interlocking means of said aisle seat modules comprise two blind rabbets, said blind rabbets are adapted to interlock with said tabs; and wherein said blind rabbets and said tabs further include openings defined therethrough, said openings defined through said tabs have a different size than said opening defined through said blind rabbets, thereby allowing lateral and rotational motions between said interlocked adjacent seat modules.

3. The interlocking seating system of claim 2 wherein said body member provides a recessed area for receiving a plate having indicia thereon.

4. The interlocking seating system of claim 3 wherein said recessed area is tilted upward.

5. An interlocking seating system comprising:

a support understructure;

a plurality of seat modules, each of said seat modules includes a body member having a first interlocking means and a second interlocking means respectively positioned on a first and an opposing second side of said body member; and, plurality of fasteners;

wherein the interlocking means of a first seat module is adapted to receive the interlocking means of a second seat module, thereby allowing two adjacent seat modules to interlock and be secured to said support understructure by said fasteners inserted through said interlocked interlocking means;

wherein each said body member further comprises reinforcement means for added rigidity, a curved front, a curved top, and a bottom having a concave surface formed therein; and wherein said concave surface engages said curved top when said curved top is deflected downward by weight of an occupant.

6. The interlocking seating system of claim 5 wherein said seat modules are formed of plastic polymers.

7. The interlocking seating system of claim 6 further comprising end caps adapted for placement at an aisle of a seating row, said end caps include positions for receiving numbering and advertising plates.

8. The interlocking seating system of claim 4 wherein said openings defined through said tab of said interior seat module comprise a front elongated slot and a rear elongated slot, and wherein said rear slot is longer than said front slot.

9. The interlocking seating system of claim 4 wherein said openings defined through said tabs of said interior seat modules are notches.

10. A seat module for installation on a support comprising:

a one-piece body member having a first and a second engagement member disposed at a first and an opposing second side of said body member, respectively;

said first and second engagement members further including openings therethrough for receiving fasteners;

wherein an engagement member of a first said seat module is adapted to receive an engagement member of a second said seat module, thereby allowing the interlocking and placement of said first and said second seat modules in a side by side relationship, to be secured to said support by fasteners through said openings; and wherein said interlocked first and second seat modules are adapted to substantially pivot relative to one another;

wherein said body member provides a recessed area for receiving a plate having indicia thereon;

wherein said first engagement member comprises a tab and said second engagement member comprises a blind rabbet; wherein said tab includes a rib disposed thereon, and said rib impinges a contacted surface of a blind rabbet of an adjacent seat module after assembly, thereby discouraging relative movement between said adjacent seat modules.

11. A seat module comprising:

a one-piece body member having a first and a second engagement member disposed at a first and an opposing second side of said body member, respectively;

said first and second engagement members further including openings therethrough for receiving fasteners;

wherein an engagement member of a first said seat module is adapted to receive an engagement member of a second said seat module, thereby allowing the interlocking and placement of said first and said second seat modules in a side relationship, to be secured to said support by fasteners through said openings;

wherein said openings defined through said first engagement member comprises a front slot and a rear elongated slot wherein said rear elongated slot is longer than said front elongated slot; and wherein said openings defined through said second engagement member are apertures.

12. A seat module for installation on a support comprising:

a one-piece body member having a first and a second engagement member disposed at a first and an opposing second side of said body member, respectively;

said first and second engagement members further including openings therethrough for receiving fasteners;

wherein an engagement member of a first said seat module is adapted to receive an engagement member of a second said seat module, thereby allowing the interlocking and placement of said first and said second seat modules in a side by side relationship, to be secured to said support by fasteners through said openings; and wherein said interlocked first and second seat modules are adapted to substantially pivot relative to one another;

wherein said body member provides a recessed area for receiving a plate having indicia thereon;

wherein said first and second engagement members comprise at least one blind rabbet recess in a side of said body member.

13. A seat module for installation on a support comprising:

a one-piece body member having a first and a second engagement member disposed at a first and an opposing second side of said body member, respectively;

said first and second engagement members further including openings therethrough for receiving fasteners;

wherein an engagement member of a first said seat module is adapted to receive an engagement member of a second said seat module, thereby allowing the interlocking and placement of said first and said second seat modules in a side by side relationship, to be secured to said support by fasteners through said openings; and wherein said interlocked first and second seat modules are adapted to substantially pivot relative to one another;

wherein said openings further include conterbores adapted to receive heads of said fasteners.

14. A seat module comprising:

a one-piece body member having a first and a second engagement member disposed at a first and an opposing second side of said body member, respectively;

said first and second engagement members further including openings therethrough for receiving fasteners;

wherein an engagement member of a first said seat module is adapted to receive an engagement member of a second said seat module, thereby allowing the interlocking and placement of said first and said second seat modules in a side by relationship, to be secured to a support by fasteners through said openings;

wherein said body member provides a recessed area for receiving a plate having indicia thereon; and wherein each said body member further includes reinforcement means to provide added rigidity, a curved front, a curved upper surface, and a bottom having a concave surface formed therein and adapted to receive said curved upper surface when said curved upper surface is being deflected down by weight of an occupant; and wherein said recessed area is tilted upward.

15. A seating system comprising:

a support having a plurality of interior seat positions and first and second end seat positions within a sitting row;

a plurality of interior seat modules adapted for placement on said interior seat positions and said first end seat position, each of said plurality of interior seat modules comprising a body member having a tab protruding from a first side and a blind rabbet recessed in a second side of said body member;

an aisle seat module adapted for placement on said second end seat position, comprising a body member having at least one blind rabbet recess in a side of said body member;

a plurality of fasteners for attaching said interior and aisle seat modules to said support;

wherein said tabs and said blind rabbets further rabbets further includes openings disposed therethrough for receiving said fasteners, said blind rabbets are adapted to receive said tabs whereby a seating row can be built by pivotably interlocking a plurality of said interior seat modules and capping said plurality of said interlocked interior seat modules with said aisle seat modules, and attaching said interlocked interior and aisle seat modules to said support by said fasteners through said openings; and wherein said body member provides a recessed area for receiving a plate having indicia thereon and wherein said recessed area is tilted upward.

16. A seating system comprising:

a support having a plurality of interior seat positions and first and second end seat positions within a sitting row;

a plurality of interior seat modules adapted for placement on said interior seat positions and said first end seat position, each of said plurality of interior seat modules comprising a body member having a tab protruding from a first side and a blind rabbet recessed in a second side of said body member;

an aisle seat module adapted for placement on said second end seat position, comprising a body member having at least one blind rabbet recess in a side of said body member;

a plurality of fasteners for attaching said interior and aisle seat modules to said support; end caps adapted for placement at said end seat position for receiving plates having indicia thereon; and wherein said tabs and said blind rabbets further includes openings disposed therethrough for receiving said fasteners;

wherein said blind rabbets are adapted to receive said tabs whereby a seating row can be built by interlocking a plurality of said interior seat modules and capping said plurality of said interlocked interior seat modules with said aisle seat modules; and wherein said interlocked interior and aisle seat modules are attachable to said support by said fasteners through said openings, wherein said body member provides a recessed are for receiving a plate having indicia thereon and wherein said recessed area is tilted upward.

17. The seating system of claim 15 wherein said openings disposed through said blind rabbets are apertures.

18. The seating system of claim 17 wherein said openings disposed through said tabs comprise a front slot and a rear slot, wherein said front and rear slots are larger than said apertures, and said rear slot is longer than said front slot, thereby allowing lateral and angular positions between adjacent seat modules to be adjusted.

19. The seating system of claim 17 wherein said openings disposed through said tabs are notches adapted to allow passage of said fasteners, thereby enabling lateral and angular position between adjacent interlocked seat modules to be adjusted.

* * * * *